US007420111B1

(12) United States Patent
Lynch et al.

(10) Patent No.: US 7,420,111 B1
(45) Date of Patent: Sep. 2, 2008

(54) DRUM SET DEVICE

(76) Inventors: Michael Francis Lynch, 10321 SE. Sherman, Portland, OR (US) 97216; John Amundsen, 2127 SE. 103rd Dr., Portland, OR (US) 97216

( * ) Notice: Subject to any disclaimer, the term of this patent is extended or adjusted under 35 U.S.C. 154(b) by 0 days.

(21) Appl. No.: 11/453,521

(22) Filed: Jun. 14, 2006

Related U.S. Application Data

(60) Provisional application No. 60/690,720, filed on Jun. 14, 2005.

(51) Int. Cl.
*G10D 13/02* (2006.01)

(52) U.S. Cl. ..... 84/421

(58) Field of Classification Search ..... 84/411 R, 84/421
See application file for complete search history.

(56) References Cited

U.S. PATENT DOCUMENTS 3,405,588 A * 10/1968 Clifford ..... 84/421
4,441,398 A 4/1984 Baker
5,337,646 A * 8/1994 Austin ..... 84/421
5,531,148 A * 7/1996 Wilson ..... 84/412
5,994,634 A 11/1999 Cady
2004/0051021 A1* 3/2004 Micheel ..... 248/346.01
2005/0274854 A1* 12/2005 May ..... 248/171
2007/0199429 A1* 8/2007 Hsieh ..... 84/422.1

* cited by examiner

*Primary Examiner*—Kimberly R Lockett
(74) *Attorney, Agent, or Firm*—Klarquist Sparkman, LLP

(57) ABSTRACT

A device for acoustic or electronic drum sets is described comprising at least a first throne section and two extending portions for accommodating drum sets or components thereof placed thereon. A particular embodiment comprises a throne section that defines a built in drum key pocket; two extensions rotatably and extendibly coupled to the throne section that can expand and collapse at least partially to accommodate drum sets or components thereof placed thereon and to facilitate transportation, at least one of the two extensions defining a handle for carrying the device; first and second arm extensions rotatably coupled to each of the two extensions; and plural levelers for leveling the device. The drum device can be configured to receive a single bass drum and single bass drum pedal; configured for use with a single bass drum and double bass drum pedal; or configured for use with a double bass drum and bass drum pedals.

11 Claims, 3 Drawing Sheets

DRUM SET DEVICE

CROSS REFERENCE TO RELATED APPLICATION

This application claims the benefit of the earlier filing date of U.S. Provisional Application No. 60/690,720, filed on Jun. 14, 2005. The entire disclosure of provisional application No. 60/690,720 is considered to be part of the disclosure of the accompanying application and is incorporated herein by reference.

FIELD

This application concerns a device placed underneath and for use with acoustic and electronic drum sets.

BACKGROUND

Drum sets include a multitude of components. Some of these components are standard to most sets, and some are optional, depending on the desires of the drummer. Most drum sets include a throne or seat for the drummer. Arrayed around the drummer are the various components. Virtually all drum sets include at least one bass drum, and perhaps two, or double, bass set ups. The bass drum is played by actuating a foot pedal with the right or left foot of the drummer. The drummer may use each foot to play the bass drum, by using two bass drums, or by employing a double bass drum pedal. The double pedal provides a second beater to strike the bass drum, which is operated remotely by a slave pedal.

The bass drums have leg extensions, called spurs, that extend downwardly from the drum to the floor. These leg extensions are intended to stabilize and secure the drum in its proper position, and are useful to maintain the bass drum in place as the drummer plays. Drummers often experience drum slide as the forward force of the beater causes the drum to creep away during play, particularly during hard drumming. Moreover, the base of the foot pedal(s), the spurs and other drum set components are made from durable metal materials, and hence can substantially damage an underlying surface.

Drum sets also typically include a device referred to as a hi-hat. A hi-hat is a stand device designed for playing two opposing cymbals. A pair of cymbals is effectively coupled to an actuating rod that is actuated by a hi-hat foot pedal. The two cymbals are positioned in facing, but opposite, orientations. When the hi-hat foot pedal is pressed, the two cymbals meet and produce sound. As with bass drum slide, drummers often experience hi-hat slide as the hi-hat slowly creeps away during play, particularly during hard drumming or if the device is standing upon a smooth or slick surface. Moreover, the base of the stand and the foot pedal again are made from durable metal materials, and hence can substantially damage an underlying surface.

SUMMARY

The present invention concerns embodiments of a device for use with acoustic or electronic drum set devices. Certain disclosed embodiments comprise at least a first pad portion and two extending portions for accommodating drum sets or components thereof that are placed thereon. The two extending portions may further comprise rotatable first and second extensions. Portions of the device can expand and collapse at least partially for use and transportation, and certain embodiments also include a handle for carrying the device. The device may comprise a resilient material on at least a portion of at least one surface thereof.

Certain embodiments further comprise a built in drum key pocket and/or levelers for leveling the device for playing on uneven surfaces. The device may be configured for use with different drum sets, such as drum sets having a single bass drum and single bass drum pedal; a single bass drum and double bass drum pedal; and/or a double bass drum and bass drum pedals.

A particular embodiment of the present invention comprises a throne section that defines a built in drum key/Allen wrench storage pocket. Two extensions are rotatably and extendibly coupled to the throne section that can expand and collapse at least partially for use to accommodate drum sets or components thereof that are placed thereon and to facilitate transportation. At least one of the two extensions defines a handle for carrying the device. First and second arm extensions are rotatably coupled to each of the two extensions. Some or all components of the device can include levelers for leveling the device. And, typically, at least a portion of the device comprises a resilient material on at least a portion of at least one surface thereof. The device includes a built-in attachment designed to secure/fasten the components during transportation.

A method for setting up and using a drum kit also is disclosed. The method comprises providing a device for use with acoustic or electronic drum sets comprising at least a first pad portion and two extending portions for accommodating drum sets or components thereof placed thereon. The method further comprises setting up a drum kit in association with the device.

DETAILED DESCRIPTION

I. General Discussion

Figure 1:
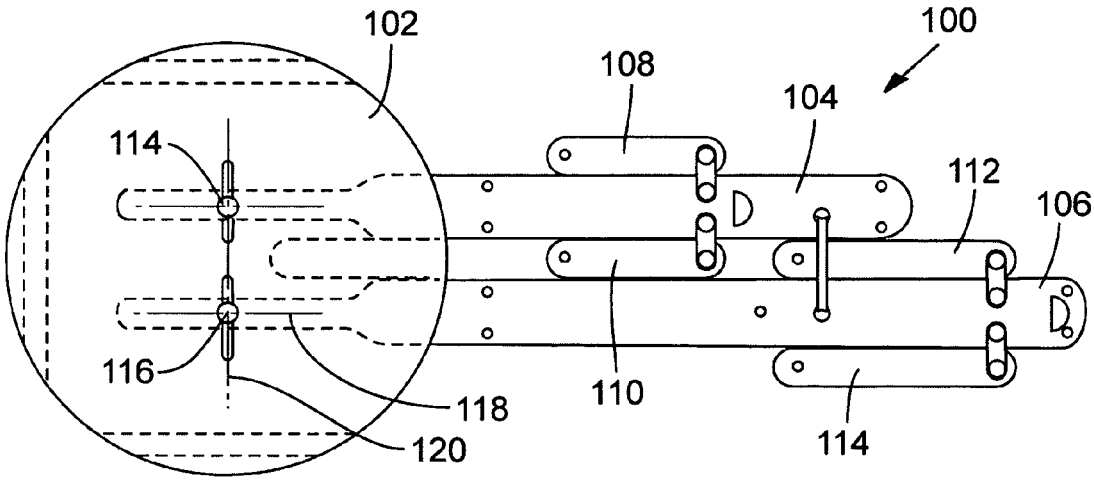
FIG. 1 shows one embodiment of a drum set device in a collapsed configuration, such as might be suitable for transporting the device from location to location, the illustrated embodiment comprising leveling feet and a seat pad.

Disclosed embodiments of the present invention concern a portable, adjustable, under-lying device designed to improve use and/or set up for musical drum sets and to address the disadvantages identified in the Background. The application can be used with acoustical or electronic drum sets. The device substantially eliminates problems associated with poor, uneven surfaces, such as uneven floors or grass, and/or problems associated with drum sets and accessories that, during use, wobble, slide, creep, and/or bounce. Disclosed embodiments also substantially prevent damage to underlying surfaces, such as floors, including marring and other damage, commonly experienced under drum sets. The device also provides the user a more consistent set up, spacing, and a solid feel with which to play in various locations.

The device folds up and all the parts are attached for easy transportation. It can be produced from any suitable material, including without limitation, metal, plastic, wood, and combinations thereof. Certain embodiments may include a resilient material, generally a softer, carpet or fabric material, which cushions the primary materials used, at least on certain components of the drum set device or portions thereof, and in some embodiments both on top and underneath surfaces. The bottom surface protects flooring and will not skid. The top provides a tough surface, or surface and fabric, ideal for solid playing. Built in stops are optionally provided to brace the bass drum(s), and other pedals.

The illustrated embodiments typically include three parts: a seat pad; and two extensions that fit under the bass drum and associated pedal(s) and stability hardware, which are part of the drum set itself. The device provides sufficient, and generally just enough, flooring to accommodate the major weight-bearing elements, e.g. the seat, bass drum and various pedals, such as the hi-hat and bass drum pedals, and other components that may be used.

The system provides a seat pad, which supports most thrones on the market today. The seat pad is adjustable so that the device settings can be expanded or contracted, or the extension angles can be increased or decreased. This allows the user to make the device conform to the desired spacing, size, reach, requirements, etc.

Also, custom designs can be produced for large and complicated drum setups, where there is a need to accommodate multiple pedal arrangements, etc.

At various locations levelers, such as leveling feet, may be installed. This allows adjustments needed to make the device compensate and provide evenness and stability over uneven flooring and rough surfaces. Levelers, in various numbers and configurations, may be provided at desired locations around the perimeter of the extensions. Certain embodiments include levelers that adjust from the top with a common drum key, and allow a user to establish a solid platform over wavy and uneven flooring conditions.

When the user is finished playing, components of the device retract and/or fold to provide a more compact unit for easy transportation. Certain embodiments include a built in handle and can be carried with one hand. Disclosed embodiments are substantially flat and not too large, and therefore conveniently can be transported and/or stored with other gear.

II. Description of Illustrated Embodiments

FIG. 1 depicts a first embodiment of a drum device 100. Drum device 100 has a first throne section 102 for underlying a drum throne during use. The illustrated embodiment of throne section 102 is substantially circular and has a diameter suitable for its function to underlie the throne. The present embodiment is not limited to having a substantially circular throne section seat pad 102, but instead encompasses all other geometric shapes and dimensions that perform the desired function.

Extending from throne section 102 are a first extension 104 and a second extension 106. Sections 104 and 106 are rotatably coupled to the throne section 102. Rotatable connections are typically achieved using any suitable fastener that effectively and securing couples the components 102, 104 and 106 together.

First extension 104 and second extension 106 are designed to underlie drum components, or at least portions of such components, such as foot pedals and leg extensions. First extension 104 can be extended from throne section 102, and can be rotated so as to extend radially outwardly from throne section 102. This allows a drummer to position extension 104 at a distance from, and at a desired radial position relative to, throne section 102. These distances and radial positions are to be set according to various drum set configurations desired by each drummer.

First extension 104 includes two extenders 108 and 110. Extenders 108 and 110 are rotatable relative to extension 104. The illustrated embodiment of device 100 includes extenders 108 and 110 of set length. These extenders 108 and 110 also can be designed to be of variable length relative to extension 104.

Second extension 106 also can be extended from throne section 102, and can be rotated relative thereto, so as to extend radially outwardly from throne section 102. Extension 106 can be positioned at a distance from, and at a desired radial position relative to, throne section 102. These distances and radial positions are to be set according to various drum set configurations desired by each drummer.

Second extension 106 includes two extenders 112 and 114. Extenders 112 and 114 are rotatable relative to extension 106. The illustrated embodiment of device 100 includes extenders 112 and 114 of set length. These extenders 112 and 114 also can be designed to be of variable length relative to extension 106.

Drum device 100 is designed for easy transport, as drum sets typically are moved from location-to-location. FIG. 1 illustrates extensions 104, 106, 108, 110, 112 and 114 in retracted and/or rotated positions useful to provide a compact device. Device 100 is then moved and placed as desired, and the extensions 104, 106, 108, 110, 112 and 114 positioned for the drummer's desired configuration.

FIG. 1 illustrates that throne section 102 can be variably positioned with respect to extensions 104 and 106. For example, by loosening the fasteners 114 and 116, extensions 104 and 106 can be moved along slots 118 and 120 as formed in throne section to provide variable movement of each component relative to the other.

Figure 2:
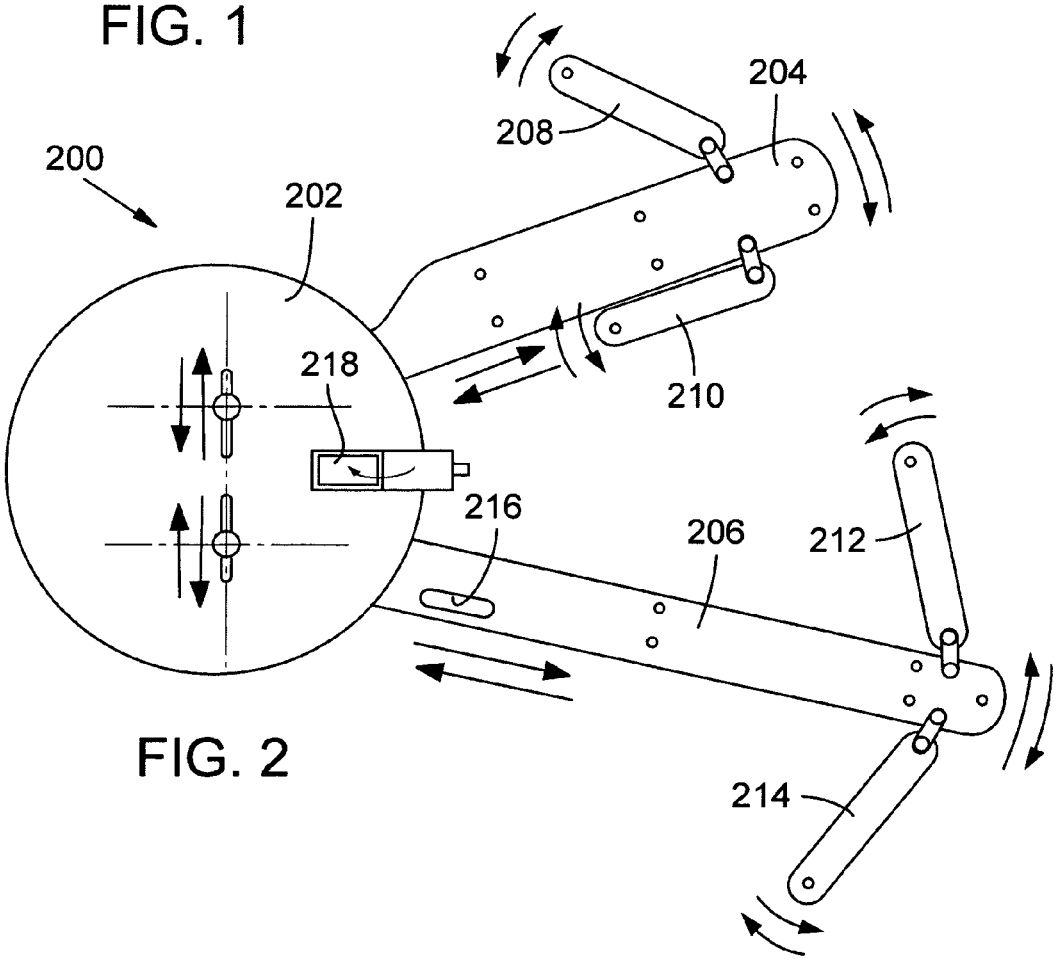
FIG. 2 illustrates the embodiment of FIG. 1 in a partially expanded configuration.

FIG. 2 illustrates the FIG. 1 embodiment in a partially expanded configuration. Thus, drum device 200 includes throne section 202, and extensions 204, 206, 208 and 210. Arrows adjacent each of the components illustrated in FIG. 2 indicate directions in which each of the components can be moved to configure the illustrated embodiments of the drum device as desired. Device 200 also includes a carrying handle 216 to facilitate transportation of the device in a collapsed configuration, such as shown in FIG. 1.

Drum device 202 also includes a recessed pocket 218. Pocket 218 is formed in the structural material used to form throne section 202. Recessed pocket 218 can be variably dimensioned to receive devices as desired by individual drummers. For example, pocket 218 can be sized to receive an Allen wrench and/or a drum key that are used to assemble drum kits, as well as embodiments of the drum device disclosed in the present application.

Figure 3:
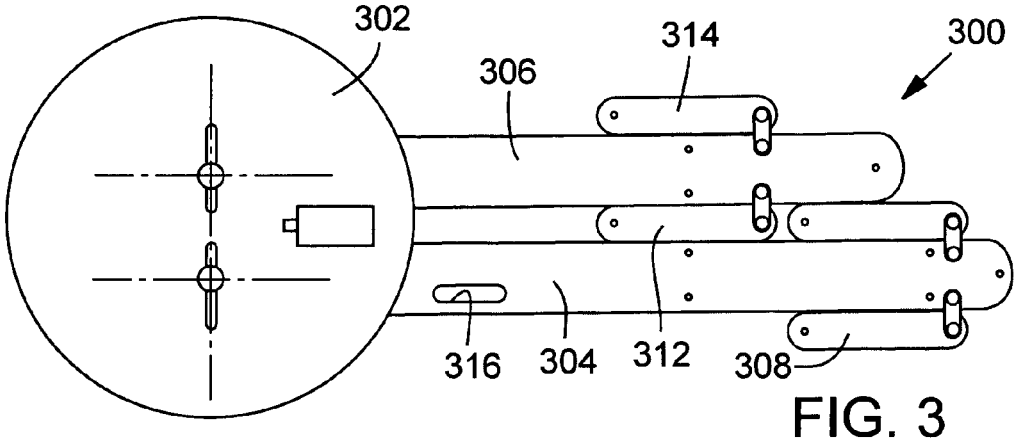
FIG. 3 is an embodiment particularly useful for a single bass drum set.
Figure 4:
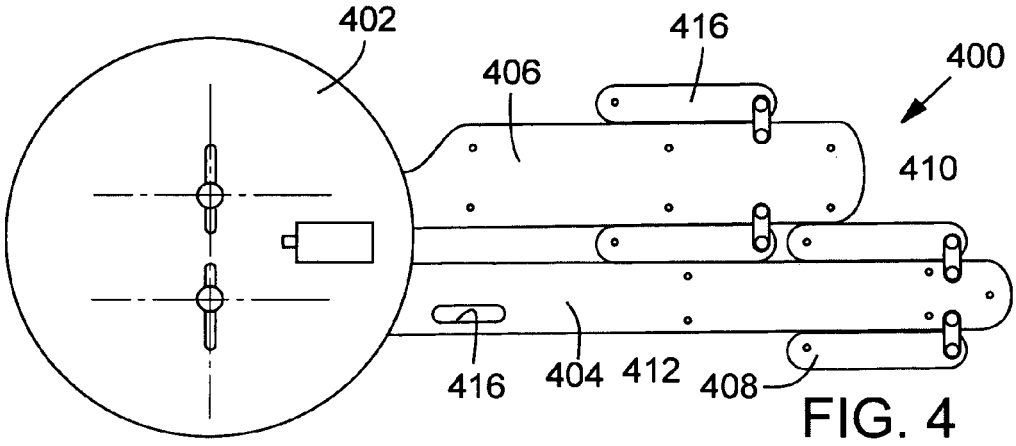
FIG. 4 is an embodiment particularly useful for a single bass or a double bass drum set with double pedal configuration.
Figure 5:
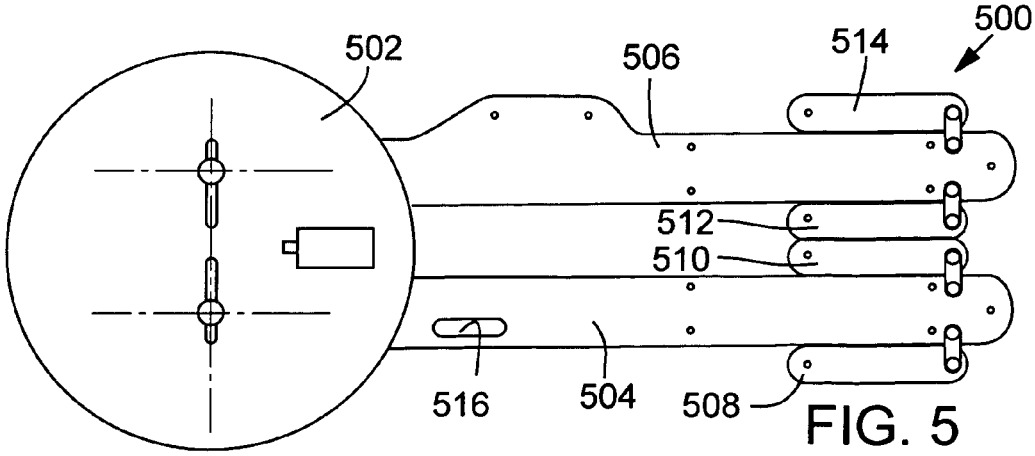
FIG. 5 is an embodiment particularly useful for a drum set having two bass drums.

FIGS. 3, 4, and 5 illustrate embodiments of the drum device that are useful for variable configurations of drum sets. The embodiment of FIG. 3 is specifically designed to receive a single bass drum, single actuating bass pedal configuration. FIG. 4 is designed for a single bass drum, but with a double actuating pedal for the bass drum. And FIG. 5 illustrates an embodiment 500 that is configured to receive a double bass drum, and double pedal configuration. Each of the embodiments includes some or all of the features described above, and common reference numbers may be used to refer to common parts. The primary differences for use with various drum kit configurations concern the shape and dimensions associated with extensions 304, 306, 404, 406 and 504, 506. For example, compare extensions 306 and 506. This comparison illustrates one difference between the embodiment 300 for a single bass drum, single pedal configuration and embodiment 500 for a double bass, double pedal configuration. Extension 306 is substantially shorter than extension 304, whereas extensions 504 and 506 are of substantially equal length. Furthermore, extensions 304 and 306 are of substantially the same shape, whereas extensions 404 and 406 have substantially different shapes, i.e. extension 406 is substantially wider than extension 404. Similarly, extensions 504 and 506 have substantially different shapes, with extension 506 having a portion substantially wider than any portion of extension 504. These different shapes and dimensions allow the embodiments 300, 400 and 500 to be used with different drum set configurations. It will be appreciated that other shapes and/or dimensions in various combinations can be used for drum set configurations other than those specifically disclosed herein.

Figure 6:
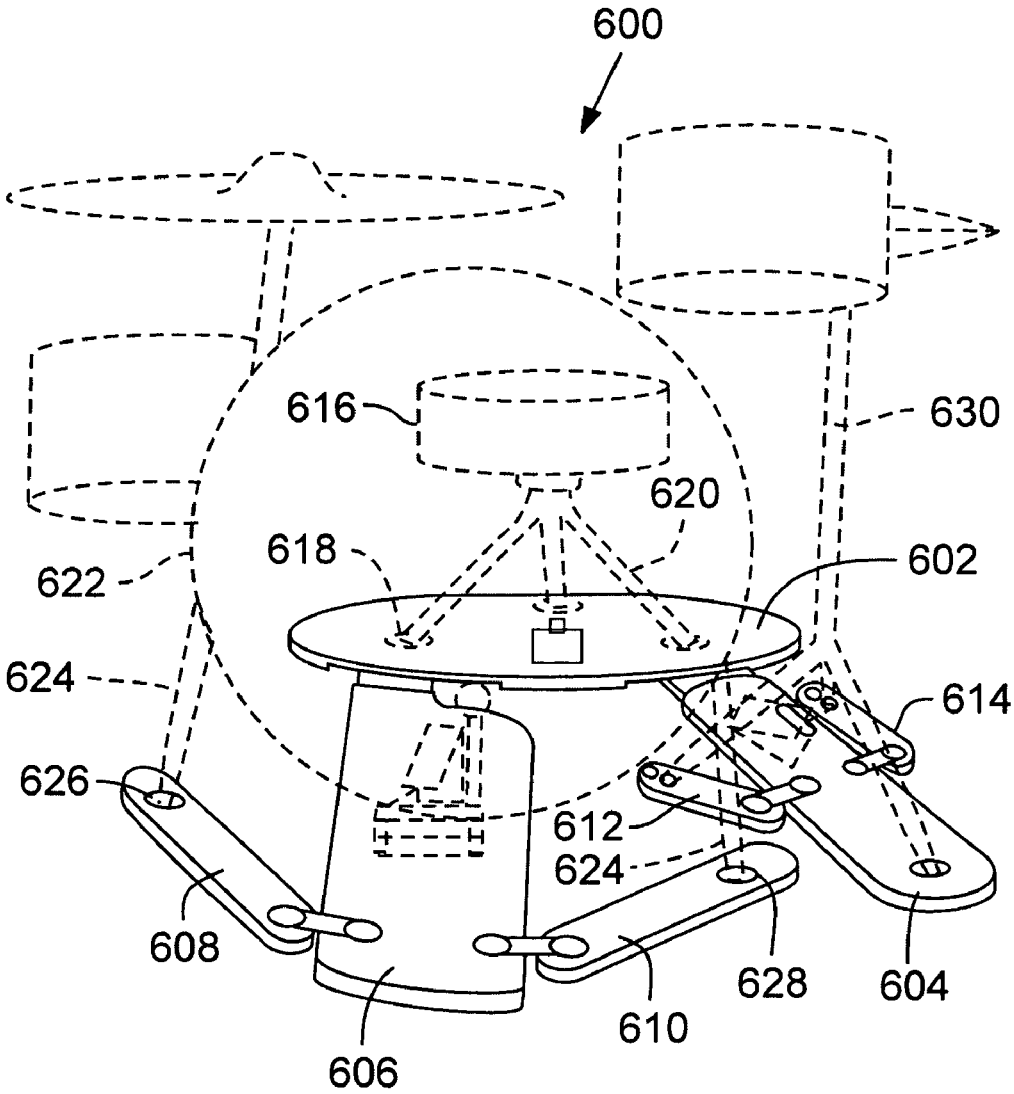
FIG. 6 illustrates an embodiment of a drum set device in an expanded configuration having drum set components placed thereon.

FIG. 6 illustrates an embodiment 600 of a drum device in an expanded configuration and having various drum components positioned thereon. Specifically, device 600 includes a throne section 602 and extensions 604 and 606. As with other disclosed embodiments, extensions 604 and 606 also include arm extensions 608, 610, 612, and 614.

With respect to use, the embodiment 600 illustrates throne 616 positioned on a top surface of throne section 602. Throne 602 may optionally include position recesses or apertures for 618 for receiving leg 620 of throne 616. Bass drum 622 has levelers and extenders 624 and 626 that are positioned on extensions 608 and 610, respectively. As with throne section 602, extender 608 optionally can include recesses or apertures 626 and 628 for receiving 624 extension arm 624 of bass drum 622. Hi-hat 630 is positioned on extension 604, 612 and 614 as indicated.

In view of the many possible embodiments to which the principles of the disclosed invention may be applied, it should be recognized that the illustrated embodiments exemplify the invention and do not limit the scope of the invention. Rather, the scope of the invention is defined by the following claims. I therefore claim as my invention all that comes within the scope and spirit of these claims.

We claim:

1. A device for underlying acoustic or electronic drum sets, comprising:

a throne section that underlies and supports a throne on which a drummer sits;

two extensions rotatably and extendibly coupled to the throne section that can expand and collapse at least partially for use to accommodate drum sets or components thereof placed thereon and to facilitate transportation;

first and second arm extensions rotatably coupled to each of the two extensions; and plural levelers for leveling the device.

2. The device according to claim 1 comprising a resilient material on at least a portion of at least one surface thereof.

3. A device for underlying acoustic or electronic drum sets, comprising:

a throne section;

two extensions rotatably and extendibly coupled to the throne section that can expand and collapse at least partially to accommodate drum sets or components thereof placed thereon and to facilitate transportation;

first and second arm extensions rotatable coupled to each of the two extensions;

plural levelers for leveling the device; and a built in drum key pocket.

4. The device according to claim 1 configured for use with a single bass drum and single bass drum pedal.

5. The device according to claim 1 configured for use with a single bass drum and double bass drum pedal.

6. The device according to claim 1 configured for use with a double bass drum and bass drum pedals.

7. A device for acoustic or electronic drum sets, comprising:

a throne section that defines a built in drum key pocket;

two extensions rotatably and extendibly coupled to the throne section that can expand and collapse at least partially for use to accommodate drum sets or components thereof placed thereon and to facilitate transportation, at least one of the two extensions defining a handle for carrying the device;

first and second arm extensions rotatably coupled to each of the two extensions;

plural levelers for leveling the device;

wherein at least a portion of the device comprises a resilient material on at least a portion of at least one surface thereof.

8. The device according to claim 7 configured for use with a single bass drum and single bass drum pedal.

9. The device according to claim 7 configured for use with a single bass drum and double bass drum pedal.

10. The device according to claim 7 configured for use with a double bass drum and bass drum pedals.

11. A method for setting up and using a drum kit, comprising:

providing a device for accommodating and underlying acoustic or electronic drum sets or components thereof placed thereon, the device-comprising at least a first throne section that can support a throne on which a drummer sits, two extensions rotatably and extendibly coupled to the throne section that can expand and collapse at least partially to accommodate drum sets or components thereof placed thereon and to facilitate transportation, first and second arm extensions rotatably coupled to each of the two extensions, and plural levelers for leveling the device;

positioning the device on a support surface; and setting up a drum kit on and in association with the device.

* * * * *